US006349641B1

(12) United States Patent
Bayer et al.

(10) Patent No.: US 6,349,641 B1
(45) Date of Patent: Feb. 26, 2002

(54) FEEDER UNIT FOR A SHEET-PROCESSING MACHINE

(75) Inventors: Harald Bayer, Rodgau; Georg Herzan, Oberursel/Tannus; Jens Gebel; Klemens Kemmerer, both of Seligenstadt, all of (DE)

(73) Assignee: Man Roland Druckmaschinen AG (DE)

( * ) Notice: Subject to any disclaimer, the term of this patent is extended or adjusted under 35 U.S.C. 154(b) by 0 days.

(21) Appl. No.: 09/615,916

(22) Filed: Jul. 13, 2000

(30) Foreign Application Priority Data

Jul. 16, 1999 (DE) ..... 199 33 304

(51) Int. Cl.[7] ..... B41F 16/00

(52) U.S. Cl. ..... 101/142; 101/177; 101/183; 101/217; 101/232; 101/409; 101/410

(58) Field of Search ..... 101/137, 142, 101/144, 154, 177, 183, 217, 218, 232, 408, 409, 410, 411

(56) References Cited

U.S. PATENT DOCUMENTS 1,514,049 A * 11/1924 Ichida ..... 101/183
2,515,355 A * 7/1950 Pritchard ..... 101/142
2,540,690 A * 2/1951 Pritchard ..... 101/142
3,460,473 A * 8/1969 Norton ..... 101/232
3,525,304 A * 8/1970 Norton et al. ..... 101/177
4,697,572 A * 10/1987 Simeth ..... 101/142
5,271,323 A * 12/1993 Münker ..... 101/142
5,406,884 A * 4/1995 Okuda et al. ..... 101/183
5,524,538 A * 6/1996 Voge et al. ..... 101/177
5,579,691 A * 12/1996 Voge ..... 101/183
5,873,309 A * 2/1999 Mack et al. ..... 101/232
6,205,919 B1 * 3/2001 Simeth ..... 101/183
6,283,025 B1 * 9/2001 Simeth ..... 101/183

* cited by examiner

*Primary Examiner*—Eugene Eickholt
(74) *Attorney, Agent, or Firm*—Leydig, Voit & Mayer, Ltd.

(57) ABSTRACT

A feeder unit for a sheet-processing machine having a plurality of processing units is provided. The feeder unit includes a feeder, a feed table, and a feed drum. The feed drum is double-sized or larger in that it has a diameter at least twice that of the diameter of the plate or blanket cylinder of at least one of the processing units of the sheet-processing machine. The feed drum includes at least two gripper systems distributed symmetrically on a periphery of the feed drum. The feed drum is arranged with its rotational axis on or offset vertically above a horizontal plane formed by the rotational axes of the printing cylinders in the processing units. Each gripper system is pivotally supported on the feed drum and includes a gripper shaft, at least one gripper arranged on the gripper shaft, a gripper stop bar associated with the gripper, and a front guide arranged on the gripper stop bar.

6 Claims, 3 Drawing Sheets

FEEDER UNIT FOR A SHEET-PROCESSING MACHINE

FIELD OF THE INVENTION

The present invention relates to a feeder unit for a sheet-processing machine, and, more particularly to a feeder unit suitable for sheet-fed rotary printing machines (e.g., flexographic printing machines) having printing cylinders and transfer drums, offset printing machines and sheet-fed coating machines (e.g., varnishing machines).

BACKGROUND OF THE INVENTION

A feeder unit for a sheet-processing machine is disclosed in DE 43 43 616 A1 in the context of a modular printing machine system. This feeder unit includes, inter alia, a first feed drum that cooperates with the printing cylinder of a printing unit. With reference to a plate cylinder of the printing unit which is single-sized, the feed drum is double-sized (i.e. the feed drum has a diameter and, in turn, a circumference twice that of the plate cylinder) and has two gripper systems arranged about its periphery. Additionally, a second feed drum is arranged upstream and offset vertically in the sheet delivery direction from the first feed drum. The second feed drum is the same size as the single-size plate cylinder. A third single sized feed drum—again with reference to the single-size plate cylinder—is likewise arranged vertically offset and upstream of the second feed drum. The third drum is operatively connected to a feed table that is inclined at an angle. This feed drum arrangement operates as a sheet accelerating system for a feeder unit in a preferred high-version unit construction, such as for processing board. The printing machine system is disclosed as being suitable for processing both board and paper. However, a normal feeder unit for paper processing presumably has to be exchanged with a high-version feeder unit as a complete subassembly in order to process board material.

One disadvantage with this type of feeder unit is that it is relatively complicated due to the large number of drums that are utilized. Moreover, the large number of sheet transfers between drums and the curved sheet paths defined by the drums have a detrimental effect on the sheet run. Another disadvantage of this construction is that the normal feeder unit must be replaced before the feeder unit can be used as a high-stack feeder.

Rotating pregrippers are also known in the art. For example, a sheet feeder for printing machines is disclosed in DE-B 2 063 618 which includes, inter alia, a rotating pregripper drum with a feed table that is arranged upstream and inclined in the delivery direction. This pregripper drum has two diametrically arranged gripper systems each of which can dip or pivot into the body of the drum. In a first disclosed embodiment, the feed of sheets is carried out with the pregripper drum and a transfer drum interposed upstream of a downstream printing cylinder. In a second disclosed embodiment, the pregripper drum is arranged directly upstream of a printing cylinder. The front guides of the pregrippers are integrated into the feed table and are pivotable from below.

Likewise, a rotating pregripper for printing machines with two sheet holding systems (gripper systems) is disclosed in DE 27 18 314 A1. This reference discloses a feed table arranged upstream of the rotating pregripper in the delivery direction and a feed drum of equal diameter arranged downstream. In this configuration, the pregripper rotates at half the speed of the feed drum. The gripper systems are configured on the pregripper in such a manner that the gripper systems execute an oscillating movement either about the pregripper axis or about a shaft that is mounted eccentrically in relation to the pregripper axis. A portion of the circumferential surface of the pregripper drum projects outwards beyond the level of the feed table in such a manner that detrimentally effects the sheet feed.

OBJECTS AND SUMMARY OF THE INVENTION

In view of the foregoing, an object of the present invention is to provide a feeder unit for a sheet-processing machine which overcomes the problems with conventional feeder units, and more particularly permits a simple modular construction and allows improved sheet feeding of the printing materials.

In accordance with these and other objects of the present invention, a feeder unit is provided which can be constructed as a standard subassembly (module) comprising a feeder, a feed table and a feed drum which—with reference to a single-size blanket or plate cylinder—is at least double-size (i.e., having a diameter and, in turn, a circumference twice that of the blanket or plate cylinder). The feeder unit is arranged directly upstream of a processing unit, such as a printing or coating unit, so as to, for example, eliminate the need for special feeder printing units and allows the processing machine to be assembled entirely in a series design using essentially identical processing units. Therefore, all the printing units (e.g., offset and/or flexographic printing units, or varnishing units) can be arranged in a modular fashion as identical units within a sheet-processing machine. The modular construction provides the further advantage that the processing machine and the feeder unit itself can be produced more economically and with a minimal parts expenditure. Moreover, the feeder unit can be universally implemented with, for example, offset printing machines, flexographic printing machines or coating machines.

The feed drum also can be constructed such that it always rotates in the delivery direction thereby eliminating the time required for the return swing in conventional oscillating systems. Thus, the present invention allows the operating speed of the machine to be increased. In this case, changes on the flanks on the drive systems also do not occur thereby promoting quiet operation of the machine. Reverse-acting torques on the drive gear train are also noticeably reduced, and the drive itself has a relatively simple construction.

Improvement in the feeding of the sheets provides a further advantage of the present invention. Specifically, the inclined, or preferably horizontal, configuration of the feed table in conjunction with the double-size or larger feed drum that is arranged in relation to the feed table produce, as a result of the relatively large drum diameter, substantially less curving of the sheet-like printing material, as compared to when a single-size feed drum is used. Thus, the feeder unit can be universally used for processing relatively thin printing materials and also thicker printing materials, such as board or sheet metal, regardless of the resilient characteristics of the printing material.

The double-sized or larger feed drum is arranged on or offset vertically above a horizontal line formed by the axes of all the printing cylinders of the processing units. This arrangement allows the feed to have a high-stack configuration, even when a horizontally arranged feed table is used. There is no need to perform a complicated procedure in order to replace a normal-stack feeder with a high-stack feeder.

When a horizontally arranged feed table is used, the sheets separated by the feeder are fed to the feed drum in a horizontal delivery plane in a staggered and overlapped relation. Therefore, damage to the printing material, which, for example, can occur at the transition from the feeder to the feed table, can be avoided.

The feed table is preferably constructed as a suction-belt table. When a horizontal arrangement of the suction-belt table is used, the present invention provides the advantage that the overlapping stream on the suction-belt table can be shortened (shortening of the delivery path). Therefore, the length of the feed table can be reduced and, for example in the case of a stoppage, fewer rejects occur.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
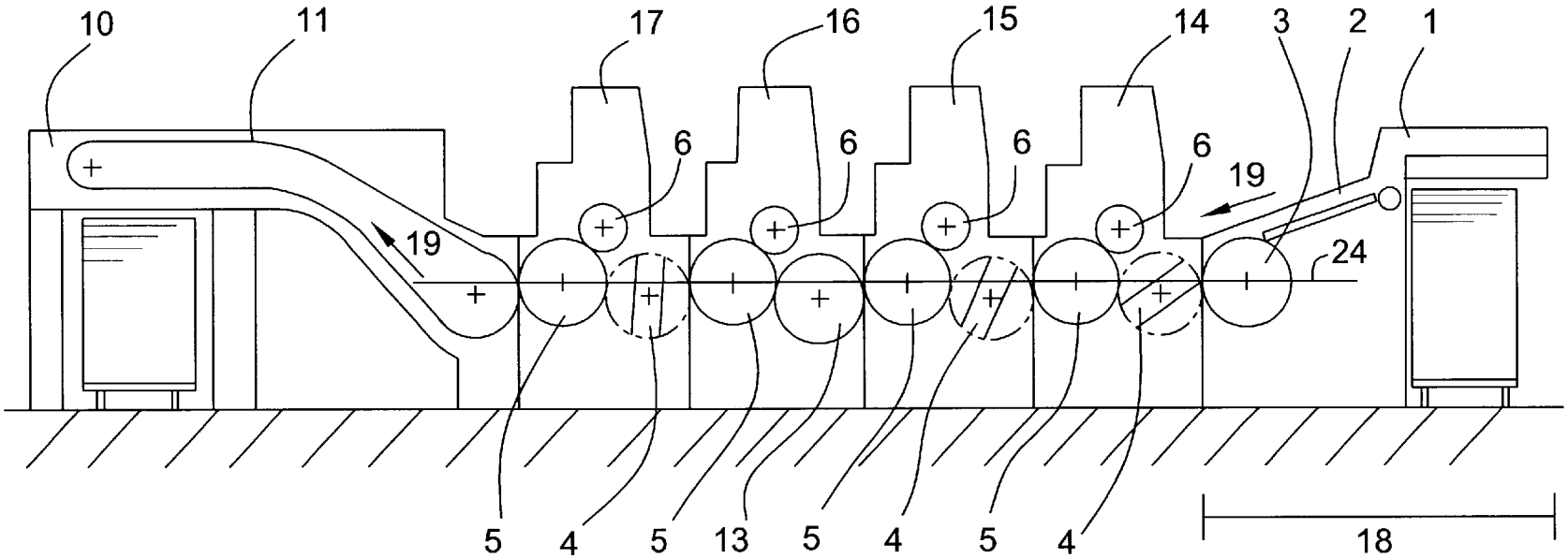
FIG. 1 is a schematic side elevation view of an illustrative sheet-processing machine having a feeder unit constructed in accordance with the present invention, processing units and a deliverer unit.

Referring now more particularly to FIG. 1, there is shown a sheet-processing machine that comprises four identical processing units 14, 15, 16, 17, a feeder unit 18 arranged upstream in the delivery direction 19 of the printing materials, and a deliverer unit 10 arranged downstream in the delivery direction 19 which includes an endlessly circulating delivery system 11. For transferring the sheet material, each individual processing unit 14–17 includes at least one transfer drum 4 and a downstream printing cylinder 5. Each printing cylinder 5 has at least one corresponding plate cylinder 6 to which it is operatively connected. As will be appreciated, depending on how the processing units 14–17 are configured, the plate cylinder 6 can comprise a blanket cylinder of an offset printing unit or a plate cylinder 6 of a flexographic printing unit or a varnishing unit.

In each processing unit 14–17, with reference to a "single-size" plate cylinder 6, the printing cylinder 5 and transfer drum 4 are, in each case, "double-sized", i.e. having a diameter, an in turn a circumference twice that of the plate cylinder. To permit recto printing operation and recto and verso printing operation (perfecting), in the illustrated embodiment, a sheet-turning unit 13 with a double-size turning drum is substituted for the conventional transfer drum 4 in the third processing unit. Alternatively, the sheet-turning unit 13 also can be substituted for an appropriate transfer drum 4 in another of the processing units 14 or 15 or 17.

In accordance with an important aspect of the present invention, the feeder unit 18 has a modular construction comprising a feeder 1, a feed table 2 and a feed drum 3 that is at least double-sized or larger with respect to the single-size plate cylinder 6. As shown in FIG. 1, the feed drum 3 of the feeder unit is arranged immediately upstream of the transfer drum 4 of a first processing unit 14. In a preferred embodiment, the feed table 2 is configured as a suction-belt table, such as is disclosed for example in DE 3331662 C2, and includes a belt retardation unit on the drive side of the table. Additionally, in one embodiment of the present invention, a measurement system is arranged on the feed table 2 which determines the actual position of one side edge of the sheet-like printing material on the feed table 2, performs an desired/actual position comparison and, by way of a pneumatic side pulling device (e.g., as disclosed in DE 4201886 C1), aligns the printing material laterally in the desired position in a controlled manner.

Figure 2:
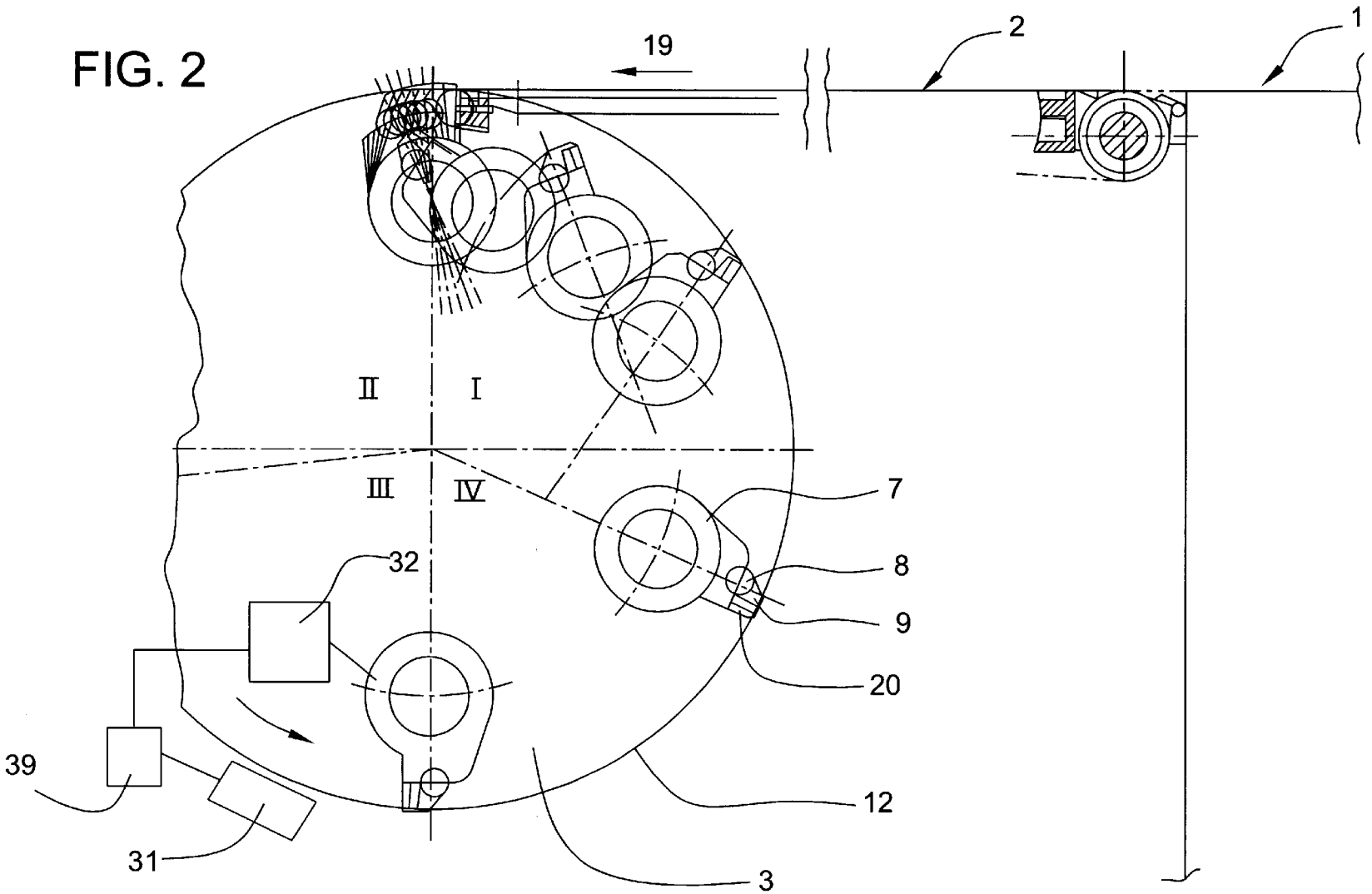
FIG. 2 is a schematic partial side elevation view of the feeder unit of the sheet-process processing machine of FIG. 1.

As shown in FIG. 2, the double-size feed drum 3 has two gripper systems 7 distributed symmetrically about the periphery of the drum (offset by 180°). Each gripper system 7 is pivotable about its axis and carries a gripper shaft 8 with a plurality of grippers 9 arranged thereon, as well as a gripper stop bar 20 that is operatively connected to the grippers 9. The feed drum 3, together with the gripper systems 7, defines an envelope circle 12 within which the gripper systems 7 can be pivoted, preferably in defined angular ranges, such that the grippers can also dip below the outer surface or the envelope circle 12 of the feed drum 3. Alternatively, a triple-size or quadruple-size feed drum 3 having three or four gripper systems 7, respectively, distributed symmetrically about the periphery of the drum can be used.

For ease of reference in connection with describing the operation of the gripper systems, the feed drum 3 is illustrated in the context of a Cartesian coordinate system in FIG. 2, with the feed drum being divided into four quadrants I–IV in the rotational direction of the feed drum. With reference to the rotational direction of the feed drum 3, a gripper system 7 in the first quadrant I is shown in the pivoted-in position with the gripper system 7 dipped below the envelope circle 12. At the transition from the first quadrant I to the second quadrant II, the gripper system 7 comes to the surface of the envelope circle and the gripper fingers 22 pass through the envelope circle. Simultaneously, as the feed drum rotates, the gripper system 7 pivots (as the gripper fingers 22 open) briefly in a direction counter to the direction of rotation of the feed drum 3 so that the gripper stop bar 20 can be positioned with the front guides 21 at the end of the feed table 2. The printing material is then transported from the feed table 2 in the delivery direction 19 to the front guides 21, the gripper fingers 22 close and the printing material is fixed in the grip of the grippers. The printing material is pulled off the feed table 2 by the gripper system 7, the feed table 2 continues to deliver the printing material and, in the transfer area, the printing material is transferred to the subsequent transfer drum 4. In the area of the feed drum represented by the beginning of quadrant II to quadrant IV, the respective gripper system is in the final position for transporting sheets. In the first quadrant I of the feed drum, the pivoting-in phase of the gripper system 7 begins (dipping under the envelope circle 12) and, at the transition from the first to the second quadrant I, II, the respective gripper system 7 again comes to the surface of the envelope circle.

In one embodiment of the invention (e.g., as shown in FIG. 1), the feed table 2 is arranged at an angle relative to the feed drum 3. However, in the presently preferred embodiment shown in FIG. 2, the feed table 2 is arranged horizontally, so that the sheet-like printing material separated by the feeder 1 can be transported over the feed table 2 to the feed drum 3, more specifically to the gripper system of the feed drum that is resting on the feed table, in a completely horizontal delivery plane. Likewise, the feed drum 3 is arranged within the feeder unit 18 underneath the feed table 2 such that the horizontal delivery plane of the feed table 2 runs tangentially to the corresponding gripper system 7 and/or the feed drum. The feed drum 3 is further arranged with its rotational axis on (in alignment with) or offset vertically (offset laterally and parallel) above a horizontal line 24 formed by intersecting the aligned rotational axes of the printing cylinders 5 of all the processing units 14–17.

Figure 3:
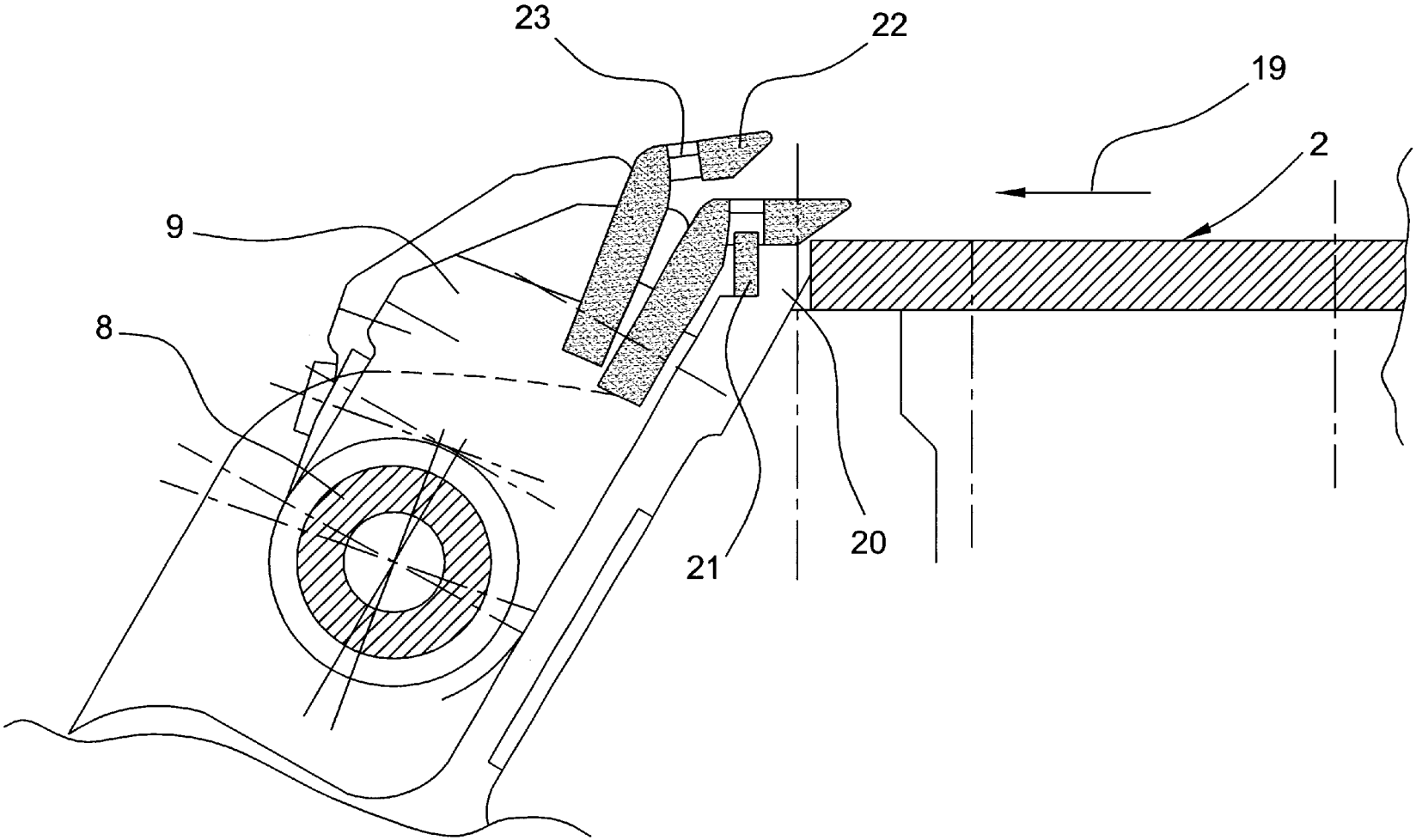
FIG. 3 is a schematic partial side elevation view of a gripper system of the feeder unit of FIG. 2 operatively connected to a feed table.

A single pivotable gripper system with the gripper shaft 8 and a gripper 9 operatively connected to the feed table 2 is shown in FIG. 3. The gripper stop bar 20, which is operatively connected to the gripper system 7, includes front guides 21 which are arranged on the gripper stop bar 20 and distributed over the width of the gripper system 7 or the feed drum. Within the gripper system 7, each gripper 9 includes a gripper finger 22 which, in a preferred embodiment, has an aperture 23 in the area of the gripper tip. Alternatively, instead of the aperture 23, a cutout that faces the gripper stop bars 20 can be arranged in the gripper finger 22. When the gripper 9 is closed, the aperture 23 or the cutout can be brought into operative connection with a front guide 21 arranged on the gripper stop bar 20.

According to a further aspect of the present invention, in addition to the optional measurement system provided on the feed table 2, a measurement system 30 (shown schematically in FIG. 2), for example a sensor system, also can be arranged adjacent to the feed drum 3 in the area of quadrants I and/or II in order to detect the position (actual value) of the printing material carried on the feed drum 3. The detecting of the position of the printing material can, for example, be with reference to at least one side edge and/or the leading edge of the sheet-like printing material. The measurement system can include a circuit connection to an evaluation unit 31 for comparing the desired/actual position and, in one embodiment of the invention, a circuit connection to a controller 32 for moving the gripper system 7 laterally or transversely with respect to the delivery direction 19.

In a further embodiment, the operative connection between the measurement system 30, the evaluation unit 31 and the controller 32 is configured such that a lateral movement of the gripper system 7 can be implemented. The operative connection between the measurement system, the evaluation unit and the controller also can be configured such that, in the event the printing material is in a crooked position relative to the delivery direction 19, the positional offset of the printing material is detected and the printing material is aligned in the desired position by the gripper system 7, which can be adjusted obliquely in or counter to the delivery direction 19. For this purpose, each individual gripper system 7 can be operatively connected to actuating devices that can be activated by the controller 32. There is sufficient time to carry out any necessary corrections to the alignment of the printing material directly on the rotating feed drum 3 in the section of the feed drum 3 between the area where the printing material is transferred from the feed table 2 to the feed drum 3 (quadrant I/II) and the area where the printing material is transferred to the downstream transfer drum 4 (quadrant II/III). As will be appreciated, the measurement systems assigned to the feed table 2 and the feed drum 3 can be used individually or jointly.

The feeder unit 18 of the present invention operates as follows. First, sheet-like printing material is separated by the feeder 1 and transported continuously in the delivery direction 19 to the feed table 2 (e.g., a suction-belt table), such that an overlapping stream of the printing material is formed (e.g., three sheets arranged in overlapping relation). On the feed table 2—after preferably detecting the actual position of the printing material via the measurement system and performing a comparison of the desired/actual positions—the sheet-like printing material is aligned with one side edge and subsequently transported in the delivery direction 19 against the front guides 21 of the gripper system, which in the meantime have been brought into position. The gripper fingers 22 then come into contact with the sheet-like printing material with the front guides 21 penetrating into the respective aperture 23, so that the gripper fingers 22 simultaneously function as top guides while the sheet-like printing material is fixed in the grip of the grippers. Alternatively, the gripper fingers 22 engage around the front guide 21 in the area of the cutout, so that the gripper fingers 22, in turn, function as top guides and fix the printing material in the grip of the grippers.

The rotating feed drum 3 then pulls the sheet-like printing material fixed in the grip of the grippers off the feed table 2 and transports it in the delivery direction 19—while the feed drum 3 is being accelerated to full machine speed. At this time, a further or an initial detection of the position of the printing material on the feed drum via the feed drum measurement system, including an evaluation of the position and corresponding correction on the feed drum 3, can be carried out. Subsequently, in the transfer zone, the printing material is transferred from the feed drum 3 to the transfer drum 4 of the first downstream processing unit 14. The printing material is then transferred from the transfer drum 4 to the subsequent printing cylinder 5 in a known manner. In terms of the modular construction of the feeder unit with respect to the downstream processing unit 14, the transition between the feeder unit and the downstream processing unit is defined between the feed drum 3 and the downstream transfer drum 4.

All of the references cited herein, including patents, patent applications, and publications, are hereby incorporated in their entireties by reference.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A feeder unit for a sheet-processing machine having a plurality of processing units each of which includes a plate or blanket cylinder and a printing cylinder, the feeder unit comprising:

a feeder, a feed table, and a feed drum that is double-sized or larger in that it has a diameter at least twice that of the diameter of the plate or blanket cylinder of at least one of the processing units and includes at least two gripper systems distributed symmetrically on a periphery of the feed drum, the feed drum being arranged with its rotational axis on or offset vertically above a horizontal plane formed by the rotational axes of the printing cylinders in the processing units;

wherein each gripper system is pivotally supported on the feed drum and includes a gripper shaft, at least one gripper arranged on the gripper shaft, a gripper stop bar associated with the gripper, and a front guide arranged on the gripper stop bar.

2. The feeder unit according to claim 1 wherein each processing unit includes a double-size printing cylinder and an upstream double-size transfer drum and the feed table is arranged in a horizontal delivery plane that forms a tangent to the feed drum which is arranged underneath the feed table.

3. The feeder unit according to claim 1 wherein the gripper has a gripper finger with an opening in the area of a gripper tip such that the gripper is operatively connected to the front guide when the gripper is in a closed position.

4. The feeder unit according to claim 2 wherein the feed drum is arranged immediately upstream of the transfer drum of a first processing unit, and each processing unit arranged downstream in the delivery direction includes a double-size transfer drum and a double-size printing cylinder.

5. The feeder unit according to claim 1 wherein the feed drum, the feed table and the feeder are constructed as a module, and an interface to a downstream processing unit that is constructed as a module is defined between the feed drum and the transfer drum of the downstream processing unit.

6. The feeder unit according to claim 1 wherein a measurement system for detecting the position of a printing material is arranged adjacent to the feed drum and is coupled to an evaluation unit and a controller, the controller being operatively connected to at least one gripper system for adjusting the position thereof.

* * * * *